US005292160A

United States Patent [19]

Deichman

[11] Patent Number: 5,292,160

[45] Date of Patent: Mar. 8, 1994

[54] DEVICE FOR PASSING A ROPE AROUND AN OBJECT

[76] Inventor: William G. Deichman, 3210 Thompson Ave., Alameda, Calif. 94501

[21] Appl. No.: 964,714

[22] Filed: Oct. 22, 1992

[51] Int. Cl.[5] ..... B25J 1/00; B63B 21/54

[52] U.S. Cl. ..... 294/19.1; 114/221 R

[58] Field of Search ..... 294/19.1; 114/221 R, 114/230; 119/151, 153; 289/6, 8, 17, 18.1

[56] References Cited

U.S. PATENT DOCUMENTS

| | | | |
|---|---|---|---|
| 2,550,770 | 5/1951 | Calemmo | 294/19.1 X |
| 2,700,252 | 1/1955 | Paganelli | 294/19.1 X |
| 2,730,985 | 1/1956 | Wingate | 294/19.1 |
| 3,072,429 | 1/1963 | Stipan | 294/19.1 |
| 3,774,953 | 11/1973 | Babcock | 294/19.1 |
| 3,813,122 | 5/1974 | Wemyss | 294/19.1 |
| 3,878,808 | 4/1975 | Mock | 114/230 |
| 4,557,214 | 12/1985 | Molitor | 294/19.1 X |
| 4,667,617 | 5/1987 | Molitor | 114/221 R |
| 5,003,907 | 4/1991 | Roach | 294/19.1 X |
| 5,082,318 | 1/1992 | Held et al. | 294/19.1 |

FOREIGN PATENT DOCUMENTS

| | | | |
|---|---|---|---|
| 2814647 | 10/1979 | Fed. Rep. of Germany | 294/19.1 |
| 1411261 | 7/1988 | U.S.S.R. | 294/19.1 |
| 1664718 | 7/1991 | U.S.S.R. | 294/19.1 |
| 250367 | 4/1926 | United Kingdom | 294/19.1 |

*Primary Examiner*—Johnny D. Cherry
*Attorney, Agent, or Firm*—James J. Leary

[57] ABSTRACT

A rope retriever device for passing a rope around an object, such as for mooring a boat. The device has a U-shaped member and a pivoting member that functions to pass a rope behind an object and back to the user. The end of a rope is held in a rope holder on one end of the U-shaped member. The rope is laced across the mouth of the U, around a pin on the pivoting member, then back to the user. The rope retriever can be activated by pushing the device against an object or, alternatively, by manually pulling on the free end of the rope. Tension in the rope causes the pivoting member to pivot across the mouth of the U until a spring clip on the end of the pivoting member clips onto the end of the rope. When the device is withdrawn, the pivoting member passes the rope around behind the object and back to the user. The device can be mounted on the end of a long pole or attached to the end of the handle on a boat hook so that it can be used for passing a rope around objects that are out of reach.

6 Claims, 2 Drawing Sheets

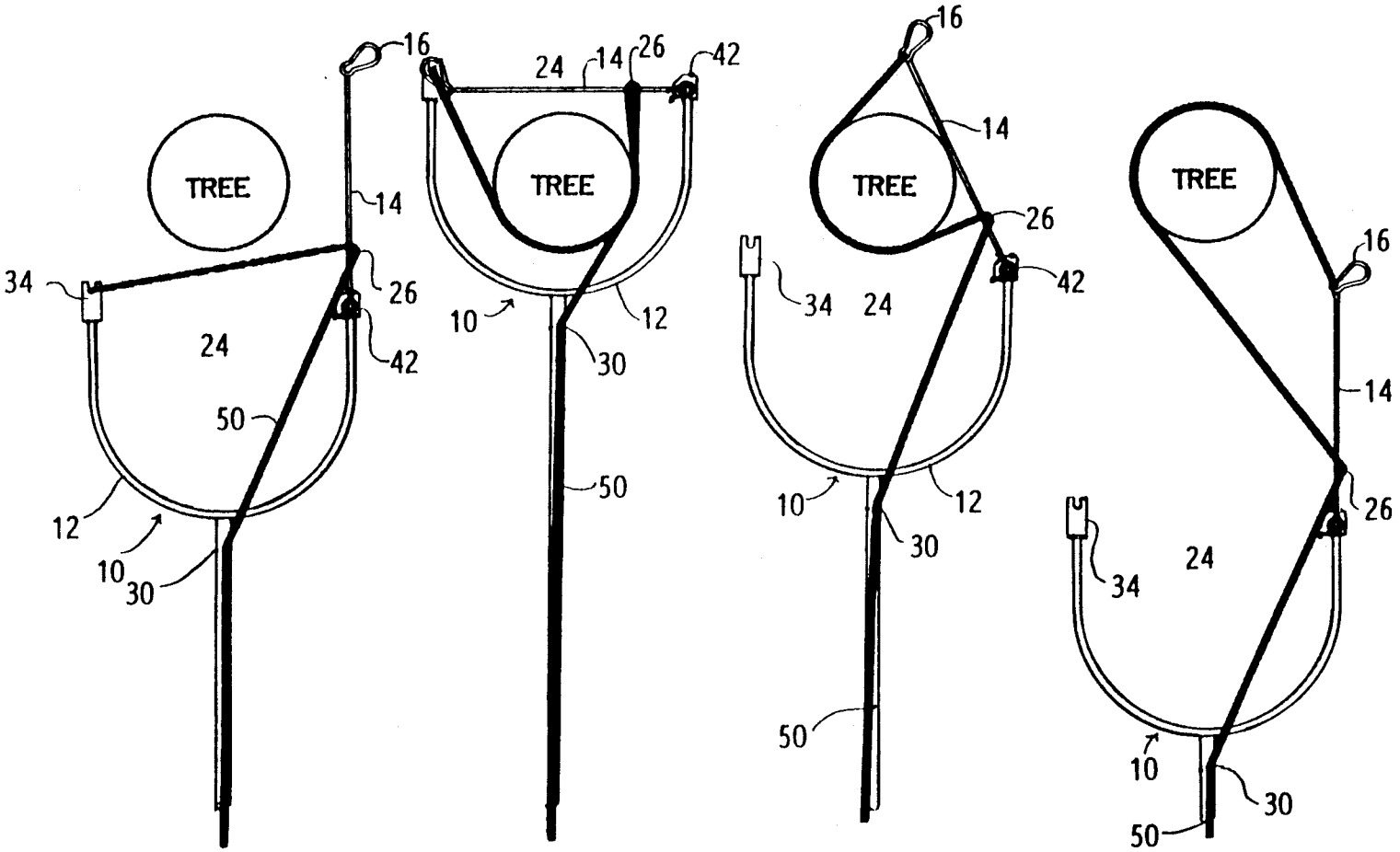
Step 1 FIGURE 3A
Step 2 FIGURE 3B
Step 3 FIGURE 3C
Step 4 FIGURE 3D

DEVICE FOR PASSING A ROPE AROUND AN OBJECT

FIELD OF THE INVENTION

This invention relates to a device for passing a rope around an object. More particularly, it relates to a device for passing a mooring line around an object for mooring a boat.

BACKGROUND OF THE INVENTION

In the course of mooring a boat, it is often necessary to pass a rope or other line around an object such as a pier or buoy eyelet that is out of reach. In these instances, it would be very useful to have a device which could be used to pass a rope around the object and retrieve it. Such a device would be useful in many other situations as well, for instance, for passing a rope around an overhead object such as a rafter or a tree limb or for retrieving a floating object that is out of reach.

Many devices have been devised for holding a rope in an open loop and dropping it over the top of a pier or other object to make fast to it. Examples of this type of device are described in U.S. Pat. Nos. 3,878,808 to Mock, 4,557,214 to Molitor, 4,667,617 to Molitor and Mendham and 5,003,907 to Roach. These types of devices are limited in their usefulness because oftentimes it is necessary to make fast to an object that is fastened at both ends, such as a railing or a column, or which is too large to pass a loop over, such as a tree. These devices also have the drawback that once the loop is around the object it cannot be easily cast off without approaching the object and untying it. This is especially inconvenient when the object the line is tied to is out of reach.

Rather than looping an object, it is often preferable to pass a rope around one side of the object and back on the other side. This way, one can cast off by simply releasing one end of the rope and letting it slide around the object. A number of attempts have been made to make a device for passing a rope or line around an object. U.S. Pat. No. 2,700,252 for a Pole Threader, granted to J. A. Paganelli on Jan. 25, 1955, describes a device that has a U-shaped member on the end of a pole. One side of the U has a rope guide that holds the end of a rope. The other side of the U has a pair of resilient fingers that pivot across the mouth of the U. The device is used by pushing it against a pole to pivot the fingers inward, allowing the pole to enter the U. Once the pole is inside the U, the fingers pivot back to grip the end of the rope. The device is then withdrawn to pass the rope around the pole and back on the other side. Because the fingers swing inward, the U-shaped member must be at least twice as deep as the diameter of the largest pole that the device is anticipated to be used with. This is a drawback when designing a device to pass a rope around large posts such as pier pilings.

U.S. Pat. No. 3,813,122 for a Device for Passing a Line Around an Object, granted to A. C. Wemyss on May 28, 1974, discloses a device with a two-armed fork on the end of a pole. A rope is attached to a shuttle that can pivotally engage either arm of the fork. The device is used by pushing it against an object to pivot the shuttle inward. Once the object is past the shuttle, the device is withdrawn which causes the shuttle to pivot outward on the opposite arm, thereby passing the rope around the object. Because the shuttle pivots inward, this device has the same drawback as the pole threader previously described. Namely, the two-armed fork must be made considerably larger than the object that the rope is to be passed around. In fact, as it is described in the patent, this device would only be useful for passing a rope around a very small diameter object such as a mooring ring.

Both of these devices have another serious drawback. In order to work, the devices must be pushed against an object. This works fine for fixed stationary objects, but it would not be effective for passing a rope around a freely moving object such as slack rope or chain or a floating object. When the device was pushed against the object, it would simply move away, which would be very counterproductive. In these instances, it would be preferable to have a device that has a means of activation other than pushing it against the object to be tied.

SUMMARY OF THE INVENTION

In accordance with the foregoing discussion it is an objective of the present invention to provide a device for passing a rope or other line around an object. The device should be able to reach distant objects that are beyond arm's length and should be able to pass a rope around an object regardless of whether it has a free end to pass a loop around. It is a another objective of the invention that the device should be able to pass a rope around a large diameter object without the device having to be ungainly large itself. It is a further objective of the invention that the device should be operable in at least two modes: an automatic mode where the device can pass a rope around an object simply by pushing the device against the object, and a manual mode where the device can be made to pass a rope around an object without the necessity of pushing against the object.

Accordingly, the present invention takes the form of a rope retriever that has a U-shaped member and a pivoting member that functions to pass a rope behind an object and back to the user. The rope retriever can be activated by pushing the device against an object or, alternatively, by manually pulling on the free end of the rope to initiate the action of the device. The rope retriever is adapted to be attached to the end of a long pole or attached to the end of the handle on a boat hook so that it can be used for passing a rope around objects that are out of reach.

BRIEF DESCRIPTION OF THE DRAWINGS

FIGS. 3A through 3D are a series of drawings illustrating the operation of the rope retriever.

DETAILED DESCRIPTION OF THE INVENTION

Figure 2:
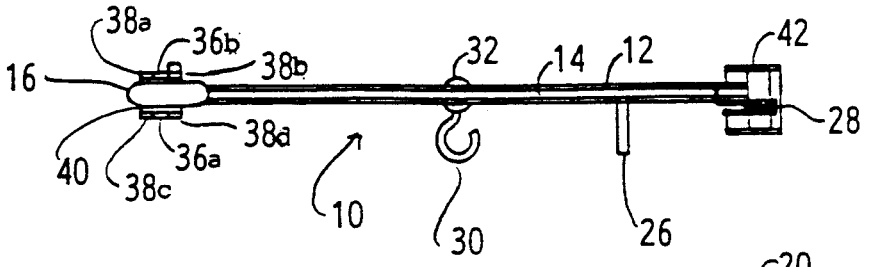
FIG. 2 shows an end view of the rope retriever device with the pivoting member in the closed or actuated position.
Figure 1:
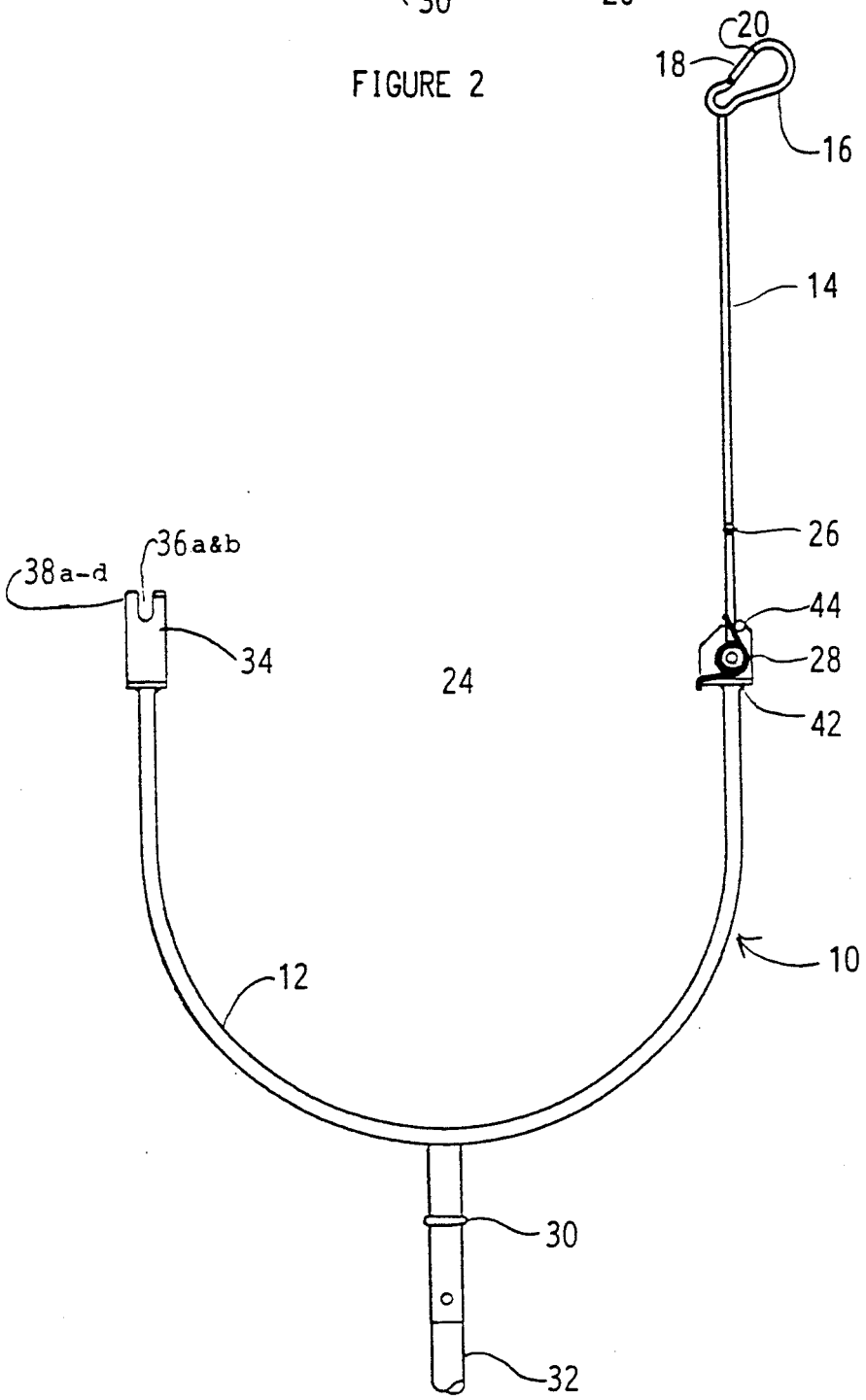
FIG. 1 shows a top view of the rope retriever device in the open position.

Referring first to FIG. 1, the rope retriever device is designated generally by the reference numeral 10. The rope retriever has a U-shaped member 12 with the mouth 24 of the U facing away from the handle 32 of the device. One end of the U-shaped member 12 has a rope holder 34 attached to it. The rope holder 34 is made with four fingers 38 a-d that are arranged with two slots 36 a and b between them to hold the end of a rope. The fingers 38 a-d are also arranged so that when the rope is inserted into the slots 36 a and b, the rope is held across a gap 40. The gap 40 can best be seen in the end view of the device in FIG. 2. The rope holder 34 can be made of a separate piece of sheet metal and welded onto the U-shaped member 12, as illustrated, or rope holder 34 may be formed integrally with the U-shaped member 12.

A pivoting member 14 is attached to a pivot 42 on the other end of the U-shaped member 12 so that it can pivot across the mouth 24 of the U. A spring 28 or other biasing means holds the pivoting member 14 against a detent 44 so that the pivoting member 14 is normally held in an open position extending away from the open mouth 24 of the U-shaped member 12. The pivoting member 14 has a spring clip 16 on the end of it for grasping the end of a rope. The spring clip 16 has an opening 20 with a latch 18 across it. The latch 18 is biased toward a normally closed position, closing the opening 20 into the spring clip 16. There is a pin 26 or a hook part-way up the pivoting member 14. The pin 26 extends perpendicular to the pivoting member as can be seen is FIG. 2. Preferably, the device also includes a rope guide 30 near the base of the U-shaped member 12.

The handle 32 of the device 10 is adapted so that it can be mounted on the end of a long pole for passing a rope around objects that are out of reach. It may also be desirable to mount the rope retriever 10 onto the handle of a boat hook to combine the functions of the two devices. It would also be possible to combine a boat hook directly into the design of the rope retriever 10 itself. The rope retriever 10 should be made of rigid, yet lightweight, materials so that it is not unwieldy at the end of the long pole. For this reason, in the preferred embodiment, the U-shaped member 12 is made of stainless steel tubing which is just about as rigid as a solid rod of the same diameter, but is considerably lighter in weight. It will be appreciated that the spring clip 16 can be made separately and then welded into place on the end of the pivoting member 14 or the two can be made integrally. Likewise, the latch 18 across the opening 20 of the spring clip 16 can be made of a solid bar pivoted to the body of the clip with a separate spring to urge it into the closed position or the latch 18 can be made of a single piece of spring steel that serves as both spring and latch.

OPERATIONAL DESCRIPTION

The user prepares the rope retriever 10 for use by lacing a rope 50 onto it as shown in FIG. 3A. Preferably, the rope 50 has a small ball on the end of it or another termination means such as a knot or loop. The end of the rope 50 is inserted into the slots 36 a and b in the rope holder 34 so that it is held across the gap 40. The rope 50 is then laced across the mouth 24 of the U-shaped member 12, around the pin 26 on the pivoting member 14 and through the rope guide 30. The user holds the free end of the rope 50 while holding the pole onto which the rope retriever 10 has been mounted.

To operate the rope retriever 10, the user advances the device toward an object such as a tree, until the rope 50 across the mouth 24 of the device comes in contact with the object. Advancing the device 10 further causes a tension on the rope 50 which pulls on the pin 26 causing the pivoting member 14 to pivot across the mouth 24 of the U. When the pivoting member 14 reaches the fully closed position shown in FIG. 3B, the latch 18 of the spring clip 16 comes into contact with the rope 50 where it is held across the gap 40. The latch 18 of the spring clip 16 opens and the rope 50 enters the opening 20. Then the latch 18 closes and the end of the rope 50 is trapped by the spring clip 16.

The user then withdraws the rope retriever 10 as shown in FIG. 3C, releasing the tension on the rope 50. The spring clip 16 pulls the rope 50 out of the rope holder 34 and the pivoting member pulls the rope 50 across behind the object. The user finishes the process by continuing to withdraw the device 10, as shown in FIG. 3D, while letting out slack on the rope 50 until both ends of the rope 50 are within the user's grasp. The user can then pull the rope 50 to bring the boat closer to the mooring or make fast to the object in whatever way is convenient.

In the alternative procedure, when the rope retriever is used to pass a rope around an object that is not fixed in place such as a slack rope or chain or a floating object, the device 10 is advanced until the rope 50 contacts the object as in FIG. 3A. Then, instead of advancing the device 10 further, the user pulls on the free end of the rope 10 to cause enough tension to make the pivoting member 14 pivot across the mouth 24 of the U-shaped member 12 until the spring clip 16 can grasp the end of the rope 50. Then the procedure is finished by withdrawing the device 10 and letting out slack in the rope 50 as before.

CONCLUSIONS, RAMIFICATIONS AND SCOPE

From the foregoing description, it can be seen that the present invention provides a convenient and effective device for passing a rope or other line around an object. It can also be seen from the geometry of the device that it can effectively pass a rope around an object that is nearly as large in diameter as the inside of the device itself. Although the examples given include many specificities, they are intended as illustrative of only some of the possible embodiments of the invention. Other variations of the device are possible. For instance, the pivoting member could be made curved or semicircular, instead of straight as shown in the drawings, and the device would be equally effective. In fact, the geometry of the device could be reversed so that the stationary member is straight or only slightly curved and the pivoting member could be U-shaped. Likewise, it would also be possible to provide the rope retriever with a separate actuation means that would cause the pivoting member to move without depending on the tension in the line to provide the operating force. Those skilled in the art will no doubt be able to devise other variations that do not depart from the spirit of the invention. Thus, the examples given should only be interpreted as illustrations of some of the preferred embodiments of the invention, and the full scope of the invention should be determined by the appended claims and their legal equivalents.

I claim:

1. A device for passing a line around an object, comprising: p1 a stationary member having a first end and a second end, said first end of said stationary member having a line holding means, a pivoting member having a first end and a second end, said first end of said pivoting member being pivotally attached to said second end of said stationary member, said second end of said pivoting member having a line grasping means, said pivoting member having a pin means extending therefrom at a point intermediate said first end and said second end, and a biasing means which normally urges said pivoting member to pivot away from said stationary member, whereby when a line is placed so that an end of said line is held in said line holding means and the body of said line extends from said line holding means and passes around said pin means and a tension is created in said line, said pivoting member will be caused to pivot with respect to said stationary member until said line grasping means approaches said line holding means and said line grasping means grasps said line proximate said end and removes said line from said line holding means.

2. The device of claim 1 wherein said stationary member is a U-shaped member.

3. The device of claim 1 wherein said line grasping means is a spring clip having a latch across an opening in said spring clip, said latch being biased toward a closed position such that as said latch bears against said line said latch moves to an open position, and when said line is within said spring clip and no longer bears against said latch, said latch moves back to said closed position thereby holding said line in said spring clip.

4. The device of claim 1 wherein said line holding means comprises a pair of spaced apart slots defining a gap between said slots, whereby when a line is inserted into said pair of spaced apart slots, said line is held across said gap.

5. A device for passing a line around an object, comprising:

a U-shaped stationary member having a first end and a second end, said first end of said stationary member having a line holding means, a pivoting member having a first end and a second end, said first end of said pivoting member being pivotally attached to said second end of said stationary member, said pivoting member having a pin means extending therefrom at a point intermediate said first end and said second end, said second end of said pivoting member having attached thereto a spring clip, said spring clip having a latch across an opening in said spring clip, said latch being biased toward a closed position such that as said latch bears against said line said latch moves to an open position, and when said line is within said spring clip and no longer bears against said latch, said latch moves back to said closed position thereby holding said line in said spring clip, and a biasing means which normally urges said pivoting member to pivot away from said stationary member, whereby when a line is placed so that an end of said line is held in said line holding means and the body of said line extends from said line holding means across said U-shaped stationary member and passes around said pin means and a tension is created in said line, said pivoting member will pivot with respect to said stationary member until said spring clip approaches said line holding means and said spring clip grasps said line proximate said end and removes said line from said line holding means.

6. A device for passing a line around an object, comprising:

a stationary member having a first end and a second end, said first end of said stationary member having a line holding means, a pivoting member having a first end and a second end, said first end of said pivoting member being pivotally attached to said second end of said stationary member, said second end of said pivoting member having a line grasping means, an actuating means for causing said pivoting member to pivot with respect to said stationary member until said line grasping means approaches said line holding means so that said line grasping means grasps a line held by said line holding means and passes said line around an object, and a biasing means which normally urges said pivoting member to pivot away from said stationary member.

* * * * *